US005887711A

United States Patent [19]

McAuliffe

[11] Patent Number: 5,887,711

[45] Date of Patent: Mar. 30, 1999

[54] GARMENT STORAGE AND TRANSPORT

[76] Inventor: Jonathan William McAuliffe, 25 Winchester Road, Grantham, Lincolnshire, United Kingdom, NE31 8AD

[21] Appl. No.: 961,489

[22] Filed: Oct. 30, 1997

[30] Foreign Application Priority Data

Apr. 23, 1997 [GB] United Kingdom ..... 9708181

[51] Int. Cl.[6] ..... A45C 5/00; A45C 5/06; A45C 5/08; A45C 5/12

[52] U.S. Cl. ..... 206/292; 206/278; 383/907

[58] Field of Search ..... 206/292, 293, 206/298, 278, 279, 294; 383/907; 190/107, 2

[56] References Cited

U.S. PATENT DOCUMENTS

| | | | |
|---|---|---|---|
| 1,666,536 | 4/1928 | Kvare | 206/298 |
| 2,502,033 | 3/1950 | Bohn | 206/293 |
| 2,723,734 | 11/1955 | Bellamy | 190/20 X |
| 2,865,418 | 12/1958 | Bourdon | 206/8 X |
| 3,128,854 | 4/1964 | Specht | 206/298 X |
| 3,708,005 | 1/1973 | Crain | 206/292 |
| 3,842,977 | 10/1974 | Hollander | 383/907 X |
| 3,998,304 | 12/1976 | Edgerton, Jr. et al. . | |
| 4,164,275 | 8/1979 | Davis | 190/2 |
| 5,181,670 | 1/1993 | Eaton et al. | 206/298 X |
| 5,624,026 | 4/1997 | Chernoff | 206/293 X |

FOREIGN PATENT DOCUMENTS 266089 2/1927 United Kingdom .

*Primary Examiner*—Sue A. Weaver
*Attorney, Agent, or Firm*—Richard M. Goldberg

[57] ABSTRACT

A garment carrier for a pleated garment, such as a kilt, is adapted to store the garment in a rolled or furled configuration. The carrier comprises a generally cylindrical body portion forming a cavity for storage of a garment, and a closable elongate access slot which provides access to the storage cavity. A flexible sheet member forms a wrap which assists the user to roll up the garment, and also serves to hold the garment in place, such that the garment cannot slip, and therefore crease, whilst the carrier is in transit.

8 Claims, 2 Drawing Sheets

GARMENT STORAGE AND TRANSPORT

BACKGROUND OF THE INVENTION

The present invention relates to an article for the storage and transport of clothing garments, and more particularly to the storage and transport to an item of pleated clothing, such as a kilt. The invention may, of course, have other related applications.

Garment carriers for storage and transportation of items of clothing, such as suits and dresses, are well known. These often comprise a soft-sided oblong bag, typically corresponding in size to that of the garment to be stored, such as a suit. The bag includes a loop, or similar means, to co-operate with a clothes hanger, such that the garment is placed within the bag, whilst on its hanger, and held in place within the confines of the bag.

The carrier itself is often provided with an external hook, such that the entire carrier may be hung in a wardrobe for storage purposes. When the garment is to be transported, the carrier is designed to be folded in half, in order that the height of the bag is more convenient for a person to carry.

One source of creasing of clothing whilst in transit is that the user has packed the garment carelessly. Therefore in order to reduce creasing as a result of how the item is placed within a the carrier, the garment carrier must be straightforward and easy to use.

It has also been found that if an item of clothing is not held securely and snugly in place within its carrier, then there is a tendency for it to shift about in transit. It is this movement which results in creasing by the time the garment arrives at its destination.

Furthermore, there is a tendency for a garment carrier which is made of a soft flexible material to flex and bend itself during transit, which in turn leads to creasing and wrinkling of the garment inside. This does not occur in solid-walled constructions, such as conventional suit cases. This disadvantage has been accepted as inevitable, if the advantages of a light overall weight and lower cost of manufacture are to be obtained.

A particular need exists for a garment carrier which is suitable for transport and/or storage of pleated garments, such as a kilt. The storage of a kilt presents particular problems because of the need to maintain the large number of pleats in a pristine and uncreased condition.

Presently, kilts are either stored in conventional garment carriers, intended for suits or jackets, which are bulky, usually the wrong size for the garment, and suffer from the other disadvantages outlined above.

In a prior proposal for a kilt carrier, the kilt is first folded in half, with the fold running along the length of the garment, and then placed flat within an elongate carrying case. A number of buckled straps are provided to correctly locate the garment within the carrier. In order to prevent shifting of the garment whilst in transit, the straps must be fastened tightly, which may itself lead to creasing of the garment in the vicinity of the straps.

SUMMARY OF THE INVENTION

Therefore, it is an object of the present invention to provide a garment carrier which is suitable for use in respect of a pleated garment of clothing, such as a kilt; and/or to provide a garment carrier which is easy to use; and/or to provide improvements in relation to one or matters discussed, or generally.

According to the present invention there is provided a garment carrier as claimed in the accompanying claims.

In an embodiment of the invention, there is provided a garment carrier for a pleated garment in which is adapted to store the garment in a rolled or furled configuration.

It has been found that the optimum method of storing a pleated garment, such as a kilt, so as to minimise creasing during storage and transport, is to roll it in a direction normal to the direction of the pleats.

A carrier according to the present invention has the convenience of prior art flexible-walled garment bag, but without requiring that the garment is folded or strapped, which may result in distortion of the garment from its intended configuration.

The storage of a pleated garment in a rolled configuration also has the advantage that the space occupied by the garment is minimised, which means that a garment carrier my be of compact construction.

Preferably, the longitudinal length of the body portion is only slightly longer than the length of the garment to the stored.

In an embodiment, there is provided a garment carrier, or bag, comprising an elongate body, preferably formed of flexible fabric or sheet material. The body of the carrier is of generally tubular construction, and includes first and second end pieces, forming a cavity for storage of a garment. In an embodiment, the end-pieces are of generally circular cross-section.

By providing a tubular member of generally circular cross section, the dimensions of the carrier can be chosen to closely mirror the dimensions of the rolled garment, thus minimising the size of the carrier.

In addition, by providing a cavity in which the garment may fit snugly, shift of the garment in transit is greatly reduced, thus reducing the main cause of creasing.

By manufacturing the carrier from a flexible material, the carrier itself may readily be rolled or folded, when not in use.

It has been found that when in use, with a rolled garment within the cavity, a compact and relatively solid overall construction is provided. The carrier resists flexing and bending of the carrier, which might otherwise lead to creasing of the garment.

Preferably the carrier is manufactured from a durable and soil resistant material, such as a plastics material, in order that the carrier will be shower proof, and easy to keep clean.

An opening, preferably in the form of an elongate slot, is provided along the length of the body portion, providing access to the storage cavity. Closure of the opening may be effected by way of a sliding, or zip, fastener, or by using a hook-and-loop type fastener, such as that available under the trade mark VELCRO.

In an embodiment, the carrier includes a garment retaining member, which serves to maintain the garment in the desired location within the cavity. The garment retaining member may comprise a flexible sheet member, or wrap, which preferably corresponds generally to the size of the garment to be stored.

In use, the garment to be stored is lain flat on the sheet member, with the lines of the pleats running substantially parallel with the longitudinal axis of the body portion. The user then rolls up the sheet member, thus rolling up the garment also, forming a "swiss roll" comprising the garment and the wrap.

The friction forces existing between layers of the wrap and the garment serve to hold the garment in place, such that the garment cannot slip whilst the carrier is in transit. The flexible wrap also holds the garment snugly in place within the cavity so that shift is minimal, thereby reducing wrinkling or creasing.

It has also been found that use of the wrap member serves to facilitate the rolling of the pleated garment, thus enhancing the ease of use of the carrier.

The flexible sheet member may be separate from the body portion of the carrier, but in a preferred embodiment, one end of the wrap is attached within the body portion in the vicinity of the entrance slot. In this embodiment, the final roll of the wrap, rolls the wrapped garment within the storage cavity, and thereby aids ease of use of the carrier.

The carrier may be provided with a loop at one, or both, ends, or other hanging means may be provided, by which the carrier and its case may be hung, for example in a wardrobe, for storage purposes.

Two D-rings may be provided, one at each end, to serve as an attachment point for a shoulder strap for the bag. Alternatively, or additionally, a carry handle may be provided.

By constructing the carrier of a flexible material, the storage of the carrier when not in use is made easier, and the carrier itself may be rolled or folded, and takes up minimal space.

The external surface of the carrier may be imprinted with indicia, such as the user's initials, clan name etc, or for advertising or promotional matter.

Variations include the addition of external or internal pockets for accessories, such as the user's sporran, sgian dubh, belt socks and shoes.

BRIEF DESCRIPTION OF THE DRAWINGS

An embodiment of the present invention will now be described, by way of example only, with reference to the following illustrative drawings in which.

DETAILED DESCRIPTION

Figure 1:
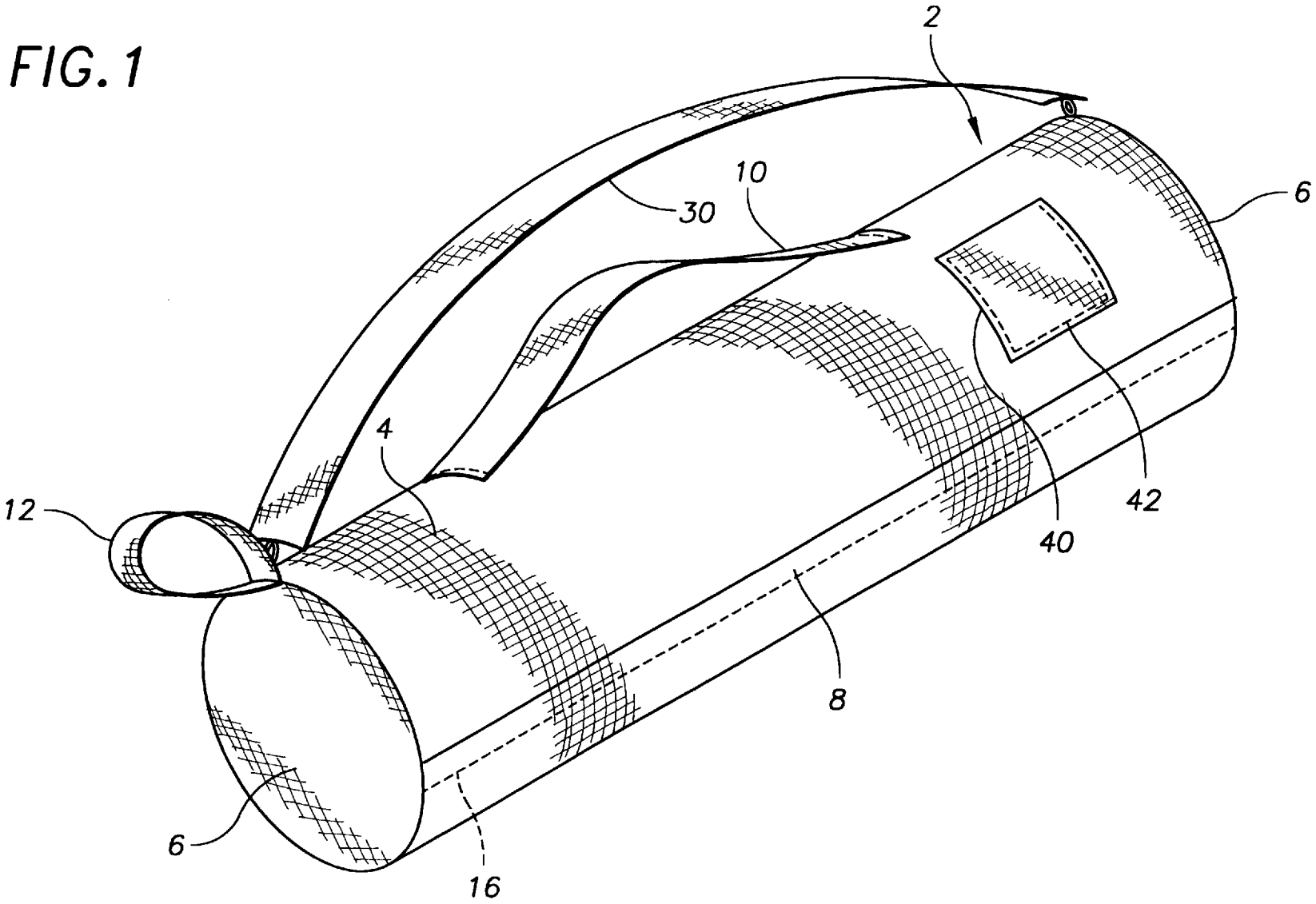
FIG. 1 is a perspective external view of an embodiment of the present invention.

As can be seen in FIG. 1, a garment carrier 2 suitable for use in the storage and transport of a pleated garment, such as a kilt, comprises an elongate body portion 4 manufactured from a flexible plastics material.

The body portion 4 is of a generally cylindrical construction, and is provided at each end with circular end caps 6, manufactured from the same material as the body portion 4. A hollow storage cavity is formed within the body portion 4, which may be accessed via an elongate slot 8. provided along the length of the body portion 4.

The slot 8 may be opened and closed using a zip fastener (not shown). Alternatively the opening could be resealably opened using VELCRO™.

A carrying handle 10, and a loop for hanging the carrier 12 are also provided.

A flexible sheet member forming a garment wrap 14 is attached to the body portion in the vicinity of the entrance slot 8 by a row of stitching 16. The wrap 14 extends along the length of the slot 8, as can be seen in FIG. 2A.

In use, the carrier 2 with the wrap 14 extended is lain on a flat surface, such as a table or bed. The garment to be stored K is lain on the wrap 14 with the direction of the pleats running parallel with the longitudinal axis of the body portion 4, as can be seen in FIG. 2A. Preferably, the top of the garment T is placed at the same side of the wrap 14 as the hanging loop 12. This prevents the weight of the garment, which is greatest at the top, from pulling the garment to the bottom of the carrier 2, if the carrier 2 is hung in a vertical orientation on the loop 12.

Figure 2B:
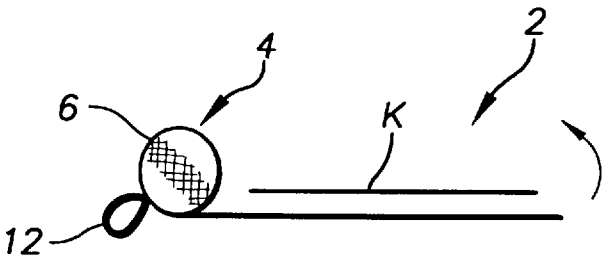
FIG. 2A to FIG. 2C illustrate use of the embodiment of FIG. 1.
Figure 2C:
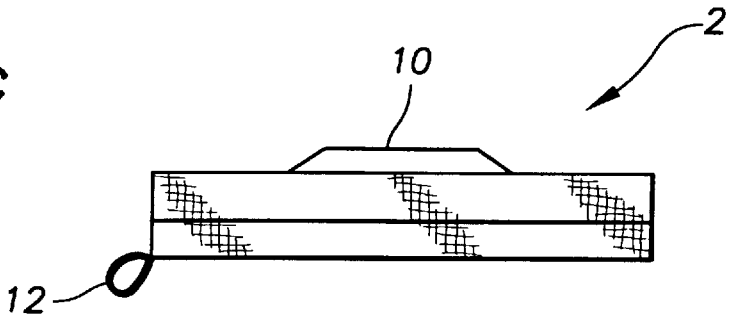
Figure 2A:
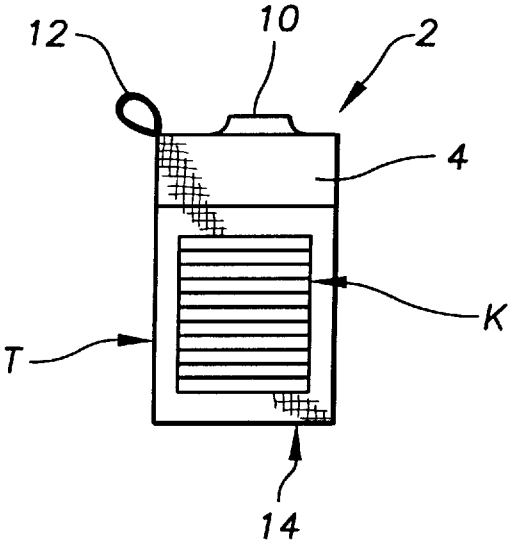

As can be seen in FIG. 2B, the user then rolls the wrap 14, and hence the garment K, towards the body portion 4. The wrap 14 substantially immobilises the garment K between the layers of the roll. The final roll takes the wrap 14 and garment K neatly within the storage cavity, and the zip provided in the slot 8 may then be closed to fasten the carrier 2, as seen in FIG. 2C.

In an alternative embodiment (not shown), two D-rings may be provided, one at each end, to serve as an attachment point for a shoulder strap 30 for the bag. Alternatively, or additionally, two dog clips may be provided to assist in the attachment of the carrier 2 to a conventional jacket carrier. In addition, one or more pockets 40 can be secured by stitching 42 on three sides, as is conventional for pockets, and is open at one end.

When used for storage, the carrier 2 protects the garment from dust, damp and insects such as moths. For transport purposes, the carrier 2 has been found to greatly reduce creasing and wrinkling of the garment, which would otherwise result from it shifting about during transit.

I claim:

1. A garment carrier for a pleated garment which is adapted to store the garment in a rolled or furled configuration, comprising:

an elongated body portion made from a flexible material of a generally tubular construction forming a cavity for storage of a garment and having an entrance slot extending in a lengthwise direction of said body portion, and a garment retaining member comprising a flexible sheet member attached to the body portion in a vicinity of the entrance slot, said flexible sheet member adapted to be lain flat outside of said body portion for positioning the garment thereon and then rolled up and positioned in a rolled condition in the body portion for carrying.

2. A garment carrier according to claim 1 wherein the body portion is of a generally circular cross-section.

3. A garment carrier according to claim 1 wherein the carrier is manufactured from a flexible fabric.

4. A garment carrier according to claim 1 wherein the carrier is manufactured from a flexible sheet material.

5. A garment carrier according to claim 1 further comprising a hanging loop secured to said body portion.

6. A garment carrier according to claim 1 further comprising a shoulder strap secured to said body portion.

7. A garment carrier according to claim 1 further comprising a carry handle secured to said body portion.

8. A garment carrier according to claim 1 further comprising at least one pocket in said body portion for holding accessories.

* * * * *